US005561930A

United States Patent [19]

Ashley et al.

[11] Patent Number: 5,561,930

[45] Date of Patent: Oct. 8, 1996

[54] BEVERAGE AND OTHER PRODUCT CONTAINER DISPLAY AND MOUNT

[75] Inventors: Chris M. Ashley; Bryan C. Aukamp; James S. Jepsen; Lee A. Witt, all of St. Louis, Mo.

[73] Assignee: Stout Industries, Inc., St. Louis, Mo.

[21] Appl. No.: 410,502

[22] Filed: Mar. 24, 1995

[51] Int. Cl.[6] ..... G09F 1/08

[52] U.S. Cl. ..... 40/538; 40/617; 40/624

[58] Field of Search ..... 40/800, 538, 616, 40/617, 624, 757, 759; 248/223.21, 475.1, 497, 498; 52/38

[56] References Cited

U.S. PATENT DOCUMENTS 2,053,119 9/1936 Sturtevant ..... 248/223.21
2,870,558 1/1959 Fuller ..... 40/616 X
2,899,765 8/1959 Fuller ..... 40/538 X

FOREIGN PATENT DOCUMENTS 330410 3/1903 France ..... 40/538

*Primary Examiner*—Brian K. Green
*Attorney, Agent, or Firm*—Paul M. Denk

[57] ABSTRACT

An advertising display representative of an enlarged beverage or other product container, including a body portion of a part of a container, formed as an arcuate segment, including along its side edges integrally inturned flanges, for connecting thereto of one or more hanger brackets, which are bent into particular configurations to accommodate either the mounting of the display directly to the flat surface of a wall, or for snug attachment at the corner between a pair of walls, due to the hanger bracket being configured at an approximate 90° angle at inwardly angulated bent sections located proximate the back surface of the body portion for the container display of this type.

15 Claims, 2 Drawing Sheets

BEVERAGE AND OTHER PRODUCT CONTAINER DISPLAY AND MOUNT

BACKGROUND OF THE INVENTION

This invention relates generally to a container display, primarily for use for advertising purposes, and specifically pertains to a unique type of display formed normally of an arcuate style container for holding a retail product, and incorporating a bracket that facilitates its mounting either to a flat wall or a corner between walls.

Obviously, advertising displays have been available in the art since the inception of the advertising concept itself. Metal or wood signs, or other forms of displays, depicting advertiser's products, have long been displayed promoting the marketing and sales of merchandise. Metal signs, depicting beer, soda, and other types of beverages, in addition to seeds, or other granular merchandise, have long been fastened to any available free space and which provides ready publication and display for the promotion and sale of such merchandise.

The current invention, on the other hand, takes the concept a step further, and attempts to provide three dimensional imaging to such displays, by configuring the beverage or product container into the arcuate form, and then incorporate one or more hanger brackets proximate its back surface to facilitate the attachment of the display either to a flat wall, or at a corner between walls, providing a unique depth perceived product display, as distinct from the planar type of advertising signage previously available in the art.

SUMMARY OF THE INVENTION

This invention contemplates the provision of an arcuate form of container display, regardless whether it be a container for a beverage, such as a bottle, or can, or other product, even of the type that holds granular or related physical type content that are normally packaged in some type of a round or other curved container, as marketed. This display forms a segment of such a container, normally to greatly magnified dimensions, so as to add to its attractiveness and observance, and which may be mounted directly to a flat or approximately flat wall, or at its corner, to enhance the visual display of the beverage, or other product, as marketed. Along the edges of the formed body segment of the arcuate display, normally includes means for mounting of the display directly to a flat wall, and in the preferred embodiment, one or more hanger brackets connect and extend approximately from each side edge along the backside of its body portion, to facilitate the accommodation of the display either to a flat surface, or at a corner between flat surfaces, during suspension of an advertising display of this type.

Each bracket is formed having a short length of flat surface, proximate its outer ends, and then is bent inwardly, as approximately an angle of 135°, where each inwardly extending portion of a bracket, forming angularly bent sections, are integrally joined together at an approximately centrally vertex angle, formed generally at a 90°, so as to accommodate the mounting of this advertising display also at the corner of a pair of walls, once again, to furnish a rather unique three dimensional appearing display, either for advertising purposes, or for general ornamentation, depending upon the desires of the purchaser or user. Each hanger bracket at its ends may connect by means of fasteners, or rivets, to inwardly bent flanges integrally formed along the side edges of the body portion of the display, so that the hanger bracket(s) is totally concealed from view, as when the display is hung upon the wall, at a corner, during application. Preferably, although not necessarily, each of the outer end flattened surfaces of the bracket, or even the inwardly angulated bent sections, will include apertures, preferably for convenience formed as keyhole slots, so that fasteners previously affixed to the flat wall, or at the corner between walls, can be readily accommodated within the keyhole formed slots of each hanger bracket, to facilitate the mounting of this advertising display in place, firmly holding it to its supportive base, generally upwardly off of the floor, to add further attractiveness to the display, as used.

It is, therefore, the subject matter of this invention to provide a very observable three-dimensional formed advertising display imprinted With pictorial indicia that is representative of products that may be marketed at the commercial establishment in which the display is shown and disposed.

Another object of this invention is to provide an advertising display having three-dimensinal appearance and which may be formed of a segment of a curved product container, formed of a body portion, and which may be imprinted with advertising or other indicia upon its exposed surface, for the benefit and psychological interest and stimulant of any customers or observers nearby.

Another object of this invention is to provide an arcuate formed body portion for an advertising display, formed as a segment of a container for holding beverages or other product, and which may be mounted either directly to a flat surface, such as a wall, or suspended upwardly at a corner between walls, at the desire of its user.

Still another object of this invention is to provide a container display, or a segment of the same, which is of enhanced appearance when mounted to the surface or corner of a wall, for the purpose of stimulating sales of the representative displayed product or beverage.

These and other objects will become more apparent to those skilled in the art upon reviewing the summary of this invention, and upon considering the description of the preferred embodiment, in view of its drawings.

DESCRIPTION OF THE PREFERRED EMBODIMENT

Figure 1:
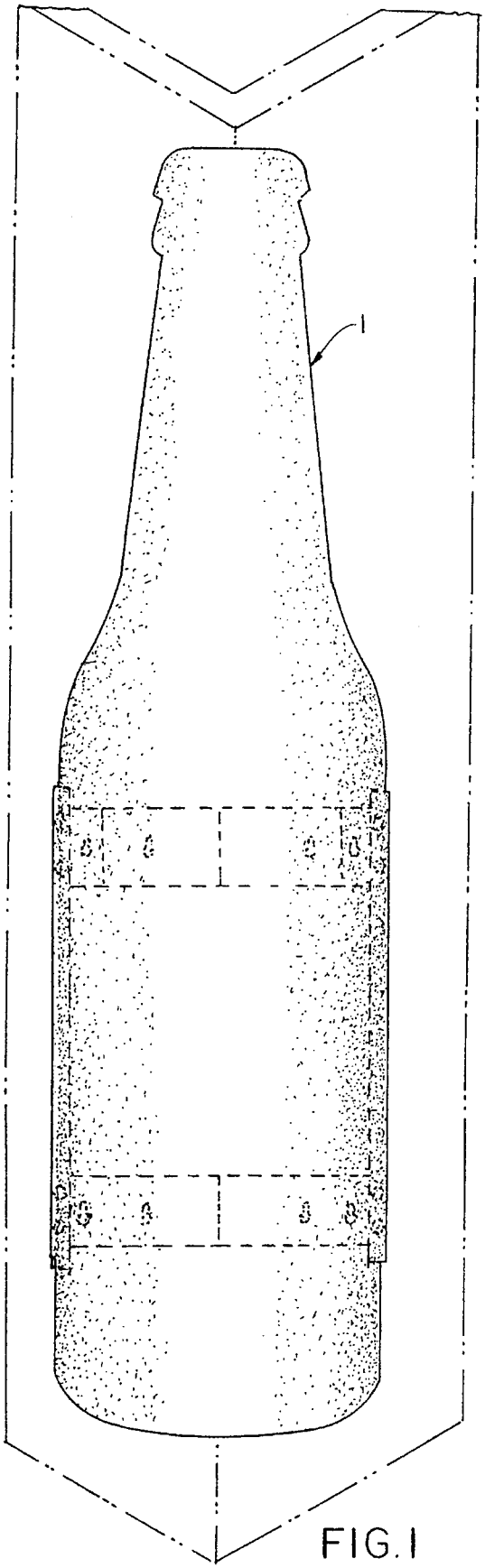
FIG. 1 is a perspective view of the container display of this invention shown mounted at the corner of a pair of walls.
Figure 2:
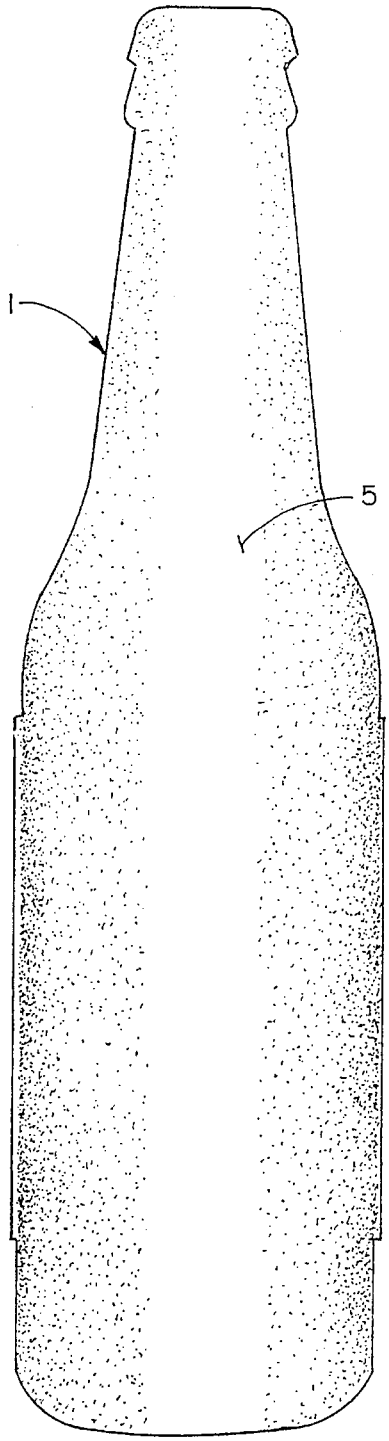
FIG. 2 is a front view of the container display.
Figure 5:
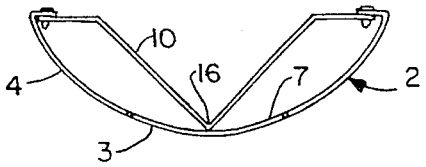
FIG. 5 is a top plan view thereof.
Figure 6:
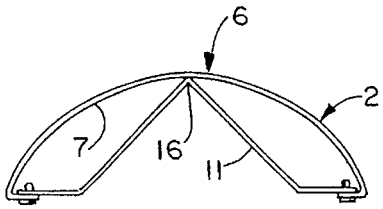
FIG. 6 is a bottom plan view thereof.
Figure 4:
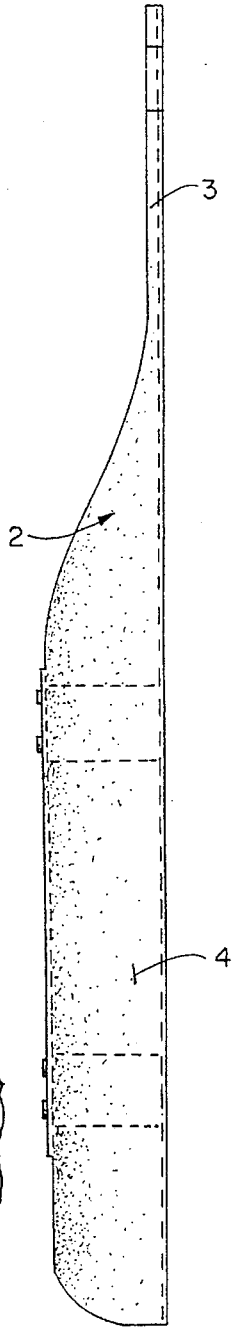
FIG. 4 is a left side view of the container display of this invention, the right side view being a mirror image thereof.

In referring to the drawings, and in particular FIGS. 1 and 2, there is shown the container display 1 of this invention, in this particular instance, being mounted at the corner between a pair of walls W, as noted. As can be seen, for this particular display, it is configured in the shape of a beverage bottle, such as a bottle of beer, or could just as equally be representative of any other bottled beverage, such as soda, or could be configured into the shape of a can of beverage, or even any other food product of the type that may be packaged within a rather round or arcuately configured container. As can also be seen in FIGS. 4 through 6, this particular container display includes a segment of an arc or a curved portion of the container, and which is bent along an arc, as noted at 2, providing continuity between the neck portion 3 of the container, down towards its base 4, as noted. Obviously, the desire is to provide a sufficient segment of the container, herein formed as an arched body portion of a container, so as to furnish sufficient three-dimensional and depth appearance to the container when mounted to a wall, such as at its corner, or upon a flat surface, but in addition, conceal the suspension components that are used to mount the display when used.

In the preferred embodiment, the particular display shown herein is a beverage container, having imprinted indicia upon its frontal surface, in this particular instance for a bottle of beer, and which is designed having a height of approximately 6 feet, in order to enhance and magnify the striking appearance of the display, when advertising the particular beverage to stimulate its marketing. A display of this type could normally be located within a market, or within a tavern, or in proximity to any other place where a beverage of this type is commercially sold. Thus, the object of the invention is to provide a display of sufficient magnitude, preferably in the range of a height of between about 5 to 7 feet, to furnish a striking appearance for such a packaged beverage, and to psychologically stimulate its sale, as can be understood.

Preferably, to attain adequate width to the container when displayed, it normally will be formed along a radius of approximately 10 to 11 inches, when bent or rolled into the arcuate form, so as to afford a width to the container from side to side of approximately 19 to 20 inches, to have compatible height and width for such a container, of this size and magnitude, when displayed.

Furthermore, when the body portion, as at 5 for this container display is molded, die cut or rolled into its curved form, it will normally already have previously been printed with indicia, under the distortion printing concept, of the particular containerized beverage or product to be represented and depicted, so that when the body portion 5 of the container, in both its integral neck 3 and base portion 4 are formed, the distortion printing will expand to provide a ready display of the authentic container, in its readable and actual dimensioned size to represent the authentic product, but one simply displayed on a much enlarged scale. Obviously, roll printing could likewise be utilized, as known in the art, to provide for the imprinting of the indicia upon the frontal curved surface, as at 6, of the display, even after it has been rolled formed into its arcuate or curved configuration. This will be at the desire of the manufacturer, when constructing a container display of this type.

Figure 3:
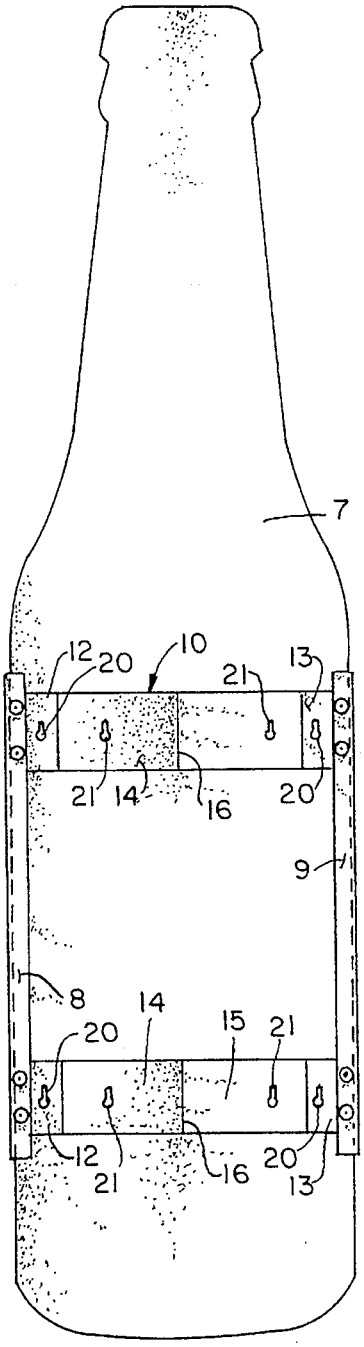
FIG. 3 is a rear view of the back surface of the container display, showing a pair of hanger brackets.
Figure 7:
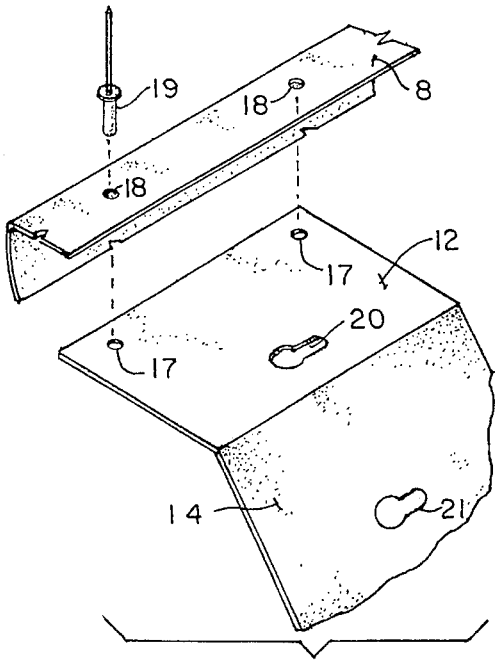
FIG. 7 is a partial view of a part of the body portion of a product container, with its integrally inwardly bent flange, and showing, in exploded view, the location of a rivet for connecting the proximate end of a hanger bracket fixedly thereto.

As also noted in FIG. 3, which provides a back view of the rear surface 7 of the display, the body portion 5 includes a pair of inwardly bent integral flanges, as at 8 and 9, formed of the shaped body portion, and to these flanges are connected one or more of the hanger brackets 10 and 11, as noted. Each hanger bracket, is likewise formed of a length of rectangular stock, preferably metal or polymer, and includes a flattened segment at each end, as at 12 and 13, which generally are arranged along a plane, so as to provide for their flush mounting directly against the surface of a flat wall, when this container display is mounted in that fashion. In addition, each hanger bracket includes an inwardly angulated bent section, as at 14 and 15, and which integrally form an interior angle, as at 16, proximate the midpoint of the back surface 7 of the display, with said integral angle forming a vertex angle of approximately 90°, so as to dispose these bent sections 14 and 15 at a right angular relationship to provide for their flush mounting of the container display at the corner between a pair of walls W, as previously explained. As can be further seen in FIG. 7, each of these flattened segments 12 and 13 are provided with a pair of aligned apertures 17 therethrough, and which mate with similar type apertures 18 formed through the contiguous flanges 8 and 9, and which may be riveted, by means of a rivet 19, together, when assembling the hanger brackets 10 or 11 to and proximate the backside of the container display 1. It is likely that the brackets 10, at their ends, may be bent and simply connect directly to the edges of the display body in lieu of the employing the flanges 8 and 9. As can be noted, this apex angle 16 generally flush mounts or is contiguous against the back surface of the body portion of the display, to add further structural support through the hanger brackets for the display when mounted either to a flat wall or at a corner between walls W, as previously reviewed.

Figure 8:
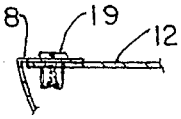
FIG. 8 is a sectional view of a rivet holding the proximate end Of the hanger bracket rigidly to the contiguous flange of the body portion of the container display.

As can also be seen in FIG. 8, these flattened segments 12 and 13 flush mount by means of the rivets 19 to the interior surface of the formed flanges 8 or 9, when the display is assembled.

To accommodate the suspension of the container display during usage, as series of apertures, such as the apertures 20 and 21 are formed through the hanger brackets, either through their flattened segments 12 and 13, or the angulated bent sections 14 and 15, or to both respectively, to furnish means for accommodating the insertion of fasteners therethrough, which fasteners (not shown) may have previously been threadedly applied, or otherwise connected to the walls, to support the type of mounting desired for the herein advertising display. As noted, these apertures may be formed as keyhole slots, which, as commonly know, can accommodate the insertion of the head of any fastener or screw therethrough, in its widened portion, but once the display is lowered, the head of the fastener is held by the narrowed portion of the keyhole slot, for suspension of the associated hanger brackets, and the entire container display, as known in the art.

The use of any type of threaded fastener, screw, or wall anchors may be previously applied to the wall, at their precise locations, to furnish the alignment and the accommodation of these hanger brackets for the advertising display, when suspended to the wall at one of the particularly defined locations.

Once assembled, and installed, the signage provided by means of the imprinted indicia formed upon the front of the surface 5 of the body portion of the display is readily depicted for viewing by anyone within sight distance of the rather enlarged advertising display of this type. Because of its size, of the magnitude as previously explained, it does provide a rather striking appearance to the observer, normally being of a size equivalent to the height of the observer, and therefore, provides quick recognition and ready advertising for the displayed product, hopefully to stimulate its sale.

Other variations or modifications to the subject matter of this invention may occur to those skilled in the art upon reviewing the container display of this invention. For example, the hanger bracket could comprise a pair of ears extending laterally outwardly from the side edges of the body portion of the container display, and accommodate the mounting of screws or other fasteners therethrough, for ready application of the display directly to the flat surface of a wall. This does not provide the extra dimension of affording the connection of this display at the corner of the walls W, but does allow for an enlarged display of this type to be quickly mounted to a wall, simply through the attachment of threaded fasteners through such formed ear brackets, for securement of this display to a wall. For example, rather than form advertising purposes, it may be that such a display may be used as an accessory for decorating a bedroom, a dormitory or fraternity house room, or for many of the other types of uses that may be considered by those skilled in the art. The description of the preferred embodiment set forth herein is done so primarily for illustrative purposes only.

Having thus described the invention, what is claimed and desired to be secured by Letters Patent is:

1. A beverage and other product container display for attachment to a flat wall or a corner, comprising:

a body portion of significant height and representative of a segment of a curved product container, said body portion having a front surface and a backside, said front surface being arcuate, said body portion formed having a lateral edge along each side, at least one hanger bracket connected proximate each side edge of the body portion and useful for suspending the container display to a wall or a corner thereof;

wherein each of said at least one hanger bracket includes a pair of flattened segments, one of the flattened segments attached to an adjacent side edge of the body portion, two generally linear bent sections, a linear bent section extends inwardly from each one of the flattened segments and said generally linear bent sections are attached to one another at one end which forms an intersection, said intersection of said two generally linear bent sections forms an interior angle of approximately 90°, each said flattened segment of the bracket includes means for accommodating the mounting of the container display to a flat wall, and each bent section of the bracket includes means for accommodating the mounting of the container display to the corner of a wall in which the wall is for fitting contiguously within the approximately 90° interior angle of said bracket.

2. The display of claim 1 wherein said container display is between about 5 feet to 7 feet in height.

3. The display of claim 2 wherein said container display is 6 feet in height.

4. The display of claim 2 wherein there are a pair of hanger brackets connected to each side edge of the body portion along its back side thereof, each hanger bracket extending from one side edge to the opposite side edge of the said body portion of the container display.

5. The display of claim 4 wherein said body portion is formed having a flange provided along each side edge, and said hanger brackets secured to said flanges.

6. The display of claim 5 wherein said flanges are inturned and extend for a short distance towards each other proximate the backside of the body portion of the container display.

7. The display of claim 5 wherein rivets secure the hanger brackets to said flanges of the wherein said front surface of the container display is imprinted body portion of the container display.

8. The display of claim 4 wherein said hanger brackets are secured interiorly of said flanges.

9. The display of claim 1 wherein said means for accommodating the mounting of the container display to a flat wall comprises an aperture.

10. The display of claim 9 wherein said aperture is a keyhole opening.

11. The display of claim 1 wherein said means for accommodating the mounting of the container display to the corner of a wall comprising an aperture.

12. The display of claim 11 wherein said aperture is a keyhole opening.

13. The display of claim 1 wherein said interior angle of the hanger bracket disposed contiguous with the backside of the body portion of the container display proximate its midpoint.

14. The display of claim 1 wherein said front surface of the container display is imprinted with pictorial indicia.

15. The display of claim 14 wherein said pictorial indicia being advertising display.

* * * * *

UNITED STATES PATENT AND TRADEMARK OFFICE

CERTIFICATE OF CORRECTION

PATENT NO. : 5,561,930

DATED : October 8, 1996

INVENTOR(S) : Chris M. Ashley, et al.

It is certified that error appears in the above-indentified patent and that said Letters Patent is hereby corrected as shown below:

Column 6, Claim 7, lines 20-21, delete "wherein said front surface of the container display is imprinted".

Signed and Sealed this
Twenty-eighth Day of January, 1997

*Attest:*

Bruce Lehman

BRUCE LEHMAN

*Attesting Officer*

*Commissioner of Patents and Trademarks*